United States Patent [19]

Huddleston et al.

[11] Patent Number: 4,819,833

[45] Date of Patent: Apr. 11, 1989

[54] MEASURING, METERING, AND MIXING CAN FOR GASOLINE AND OIL

[75] Inventors: Earl M. Huddleston, Boise, Id.; Garry F. Jervis, Paris, Calif.

[73] Assignee: Hudd Investment Trust, Inc., Las Vegas, Nev.

[21] Appl. No.: 148,032

[22] Filed: Jan. 25, 1988

[51] Int. Cl.[4] ..... B67D 5/38; B65D 1/24

[52] U.S. Cl. ..... 222/155; 222/130; 222/158; 222/183; 222/309; 222/383; 222/441; 222/444; 222/465.1; 137/576; 220/20.5

[58] Field of Search ..... 222/71, 155, 156, 158, 222/183, 309, 383, 385, 129, 434, 133, 441, 444, 450, 568, 145, 285, 288, 465.1, 628, 144.5, 130; 73/323; 116/276; 239/333, 375; 141/27, 98; 417/519; 137/576; 220/20.5

[56] References Cited

U.S. PATENT DOCUMENTS

| | | | |
|---|---|---|---|
| 455,043 | 6/1891 | Henninger et al. | 222/444 X |
| 2,428,588 | 10/1947 | Schroeder et al. | 222/465.1 X |
| 2,945,509 | 7/1960 | Tuttle | 137/576 |
| 2,986,162 | 5/1961 | Spexarth | 220/20.5 |
| 3,154,219 | 10/1964 | Dean et al. | 222/129 |
| 4,105,142 | 8/1978 | Morris, Jr. | 222/158 |
| 4,121,631 | 10/1978 | Jones | 222/385 X |
| 4,135,404 | 1/1979 | Butler | 222/158 X |
| 4,266,693 | 5/1981 | Pfeiffer | 222/385 X |
| 4,294,372 | 10/1981 | Onishi | 137/576 X |
| 4,358,027 | 11/1982 | Poitras | 222/309 X |
| 4,480,470 | 11/1984 | Tussing | 222/158 X |
| 4,509,659 | 4/1985 | Cloutier et al. | 222/444 X |

*Primary Examiner*—Joseph J. Rolla
*Assistant Examiner*—Gregory L. Huson
*Attorney, Agent, or Firm*—Paul F. Horton

[57] ABSTRACT

A measuring, metering, and mixing can, particularly for gasoline and oil, including a gasoline container with filler cap and spout; and oil container with filler cap; visual type gauges for each container; and a plunger-cylinder metering unit for withdrawing a selected amount of oil from the oil container and injecting the same into the gasoline can for producing an oil-gasoline mixture. The visual gauge on the gasoline container and the visual gauge on the oil container permit the metering of an exact amount of oil, dependent upon the amount of gasoline within the gasoline container for a precise ratio of oil-gasoline in the mixture. A hinged cover on the can protects the metering equipment during periods of non-use.

9 Claims, 1 Drawing Sheet

MEASURING, METERING, AND MIXING CAN FOR GASOLINE AND OIL

BACKGROUND OF THE INVENTION

1. Field of the Invention

This invention relates, in general, to compartmental supply containers and, more particularly, to a compartmental supply container provided with visual gauges and metering means for providing a desired ratio of a gasoline-oil mixture.

2. Description of the Prior Art

Many engines such as those for chain saws, motor boats, grass trimmers, and the like, require a gasoline-oil mixture for proper operation. For such engines, it is important that the gasoline and oil be thoroughly mixed before use and the correct ratio of oil to gasoline, in accordance with the operating manual, be provided.

Compartmentalized containers, as typified by U.S. Pat. No. 2,788,919, issued to E. L. Bostwick; U.S. Pat. No. 3,154,219, issued to W. M. Dean et al; and U.S. Pat. No. 3,756,470, issued to W. A. Bagwell et al, are now in the art. Such containers simply allow a selected amount of oil and gasoline to be poured from a self contained unit to another vessel for mixing. U.S. Pat. No. 4,169,544, issued to A. F. Blanchet, discloses a mixing and distributing apparatus for gasoline and oil. The Blanchet device is not a self-contained can for gasoline and oil; requires a pressurized source of gasoline; and provides no way for metering of a selected amount of oil into a known quantity of gasoline as may at any time be present in a gasoline can.

SUMMARY OF THE INVENTION

The present invention overcomes these problems in the prior art by providing a single unit, compartmentalized can, provided with visual gauges for the ready determination of amounts of oil and gasoline available and provided with a metering device for withdrawing a selected amount of oil from an oil compartment, as determined by the oil gauge, and injecting the same into a known amount of gasoline, as determined by the gasoline gauge, to produce an oil-gasoline mixture of selected ratio.

DETAILED DESCRIPTION OF THE INVENTION

Figure 1:
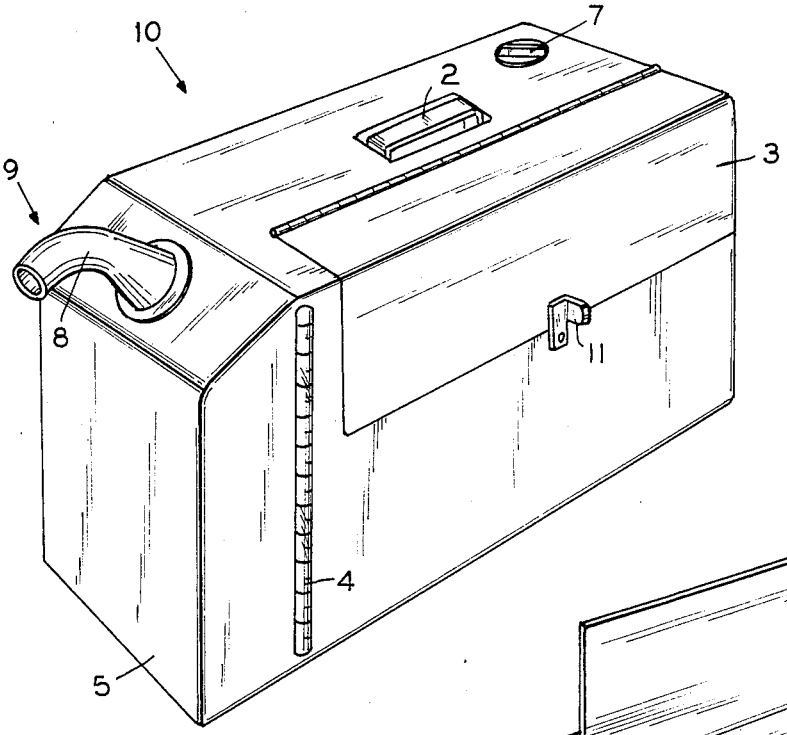
FIG. 1 is a perspective view of a preferred embodiment of the oil-gas mixture can of the present invention, showing the lid in a closed position.
Figure 2:
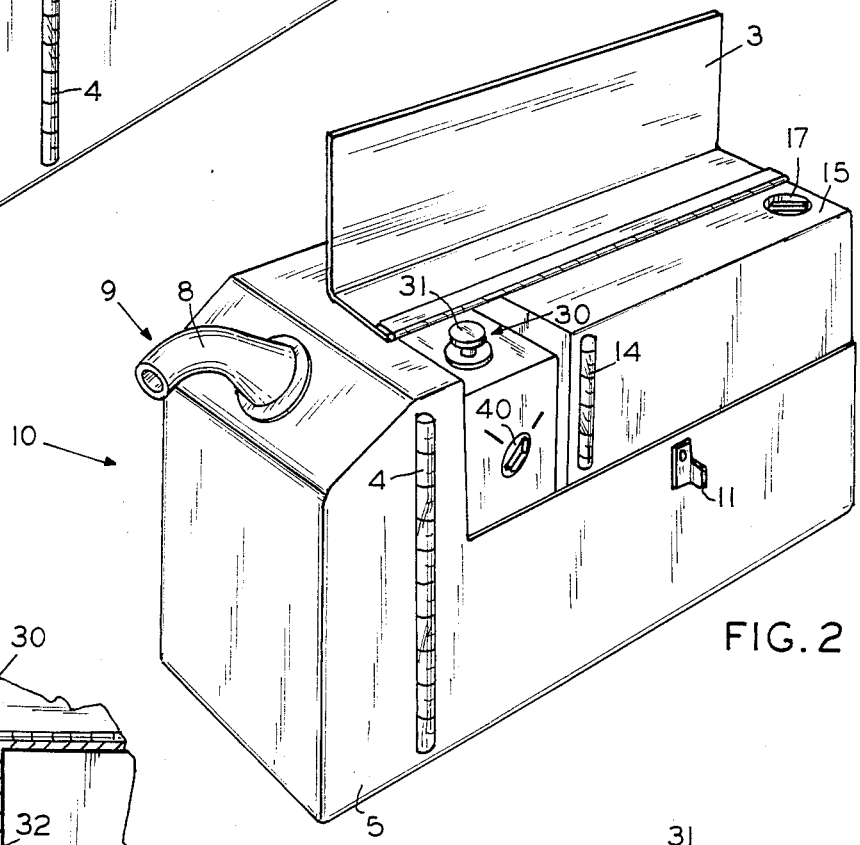
FIG. 2 is a perspective view of the can of FIG. 1, showing the lid in an open position for metering.

Referring now to the drawings, and, more particularly, to FIGS. 1 and 2, an embodiment to be preferred of a measuring, metering, and mixing can 10, made according to the present invention is disclosed. Can 10 includes a first compartment 5 provided with a filler cap 7 and a pour spout 9; a second compartment 15, also provided with a filler cap 17; a first compartment measuring gauge 4; a second compartment measuring gauge 14; and metering means, designated generally by the numeral 30.

Can 10 is constructed as a self-contained measuring, metering, and mixing unit in which amounts of liquids, as for example oil and gasoline, may be measured; in which a specified amount of oil may be withdrawn and injected into the gasoline; and in which the contents may be shaken or otherwise mixed to produce a liquid mixture of desired proportions. First compartment 5 and second compartment 15 are constructed of any suitable material, such as plastic or metal, which is non-corrosive relative to the liquids to be mixed. The compartments are spaced in a side-by-side relationship, as shown, and may include common wall portions. In that it is contemplated that the invention will be used primarily for oil-gasoline mixtures, reference will be made to a can 10 which is suitable for this purpose, although it is to be understood that compartments may be of varying size. In the embodiment shown, first compartment 5 is the larger of the two compartments and will hold approximately 5.5 gallons of liquid mixture. Second compartment 15 may hold approximately 0.5 gallon of oil. The first compartment 5 is provided with a filler cap 7 which threadably engages a filler port, not shown, and is also provided with a pour spout 9. The pour spout may be simply in the form of a port, or, as is preferred, includes a neck portion 8 which may threadably engage the port. Can 10 is also provided with a handle 2 which may be recessed or otherwise affixed to the top outer surface of the first compartment. For aesthetic purposes and also to protect the metering means 30, the can may also be provided with an L-shaped lid 3 which hingably engages the outer wall of the first compartment. The lid is kept in the closed position by means of a latch 11.

For accurate visual determination of the amount of liquid, such as gasoline, in compartment 5, a first gauge 4 is provided. Gauge 4 is preferably in the form of a transparent tube having gradation markings, as shown. The top and bottommost portions of the tube are open for receiving the liquid and expulsion of air from the tube. Similarly, second compartment 15 is provided with a second gauge 14 which also enables accurate visual determination of the amount of oil in that compartment. Construction of the second gauge may be substantially the same as the first gauge.

Figure 3:
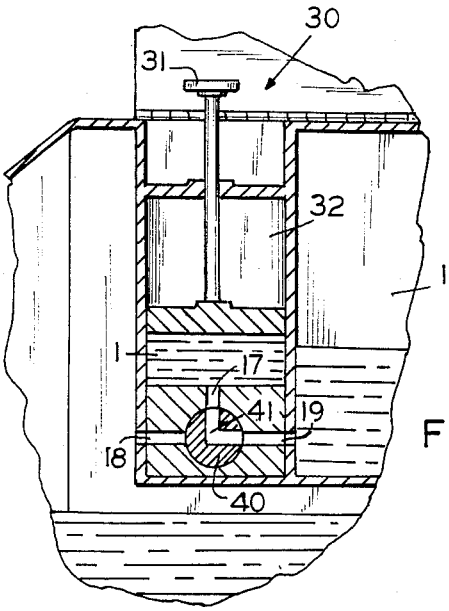
FIG. 3 is a sectional view of one embodiment of the metering apparatus.
Figure 4:
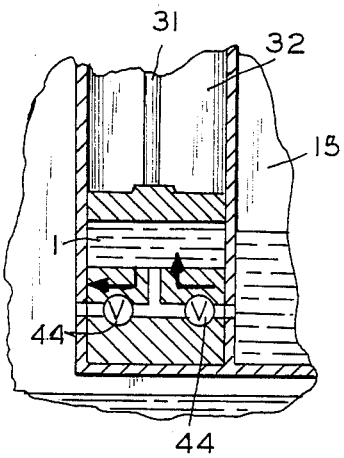
FIG. 4 is a partial sectional view of a second valve system for the metering apparatus.

For withdrawing a selected amount of oil from second compartment 15 and injecting the same into first compartment 5, metering means 30 is provided. The metering means is preferably in the form of a plunger 31-cylinder 32 unit in combination with appropriate valves, as shown in FIGS. 3 and 4. The embodiment shown in FIG. 3 includes a manually rotatable three-way valve 40 which is rotatable from the position shown for filling the cylinder to a one-quarter counter-clockwise turn for emptying the cylinder.

In lieu of manual valve 40, the metering means may be provided with check valves 44 for automatic operation. Check valves 44 may be in the form of conventional hinged flap type valves; spring loaded seated ball type valves, or other suitable valves which permit liquid flow in one direction only, as shown by the arrows.

For operation and to obtain, for example, a 50:1 ratio of gasoline to oil mixture the following procedure may be followed. Assuming that compartment 5 contains 3.5 gallons of gasoline, as determined by gauge 4, it is necessary to add 0.07 gallon of oil to the gasoline. To add this amount of oil, and utilizing the measuring means 30, shown in FIG. 3, lid 3 is first lifted to expose the metering means. Valve 40 is then rotated to the position shown in the figure with conduit 41 of the valve being in registry with conduit 19 leading from oil compartment 15 to valve 40 and with conduit 17 leading from the valve to cylinder 32. Plunger 31 is then retracted to withdraw oil 1 from compartment 15, through conduits 19, 41, and 17, into cylinder 32. Amount of oil withdrawn can be visually ascertained by means of gauge 14. Valve 40 is then rotated counter-clockwise on quarter turn so that conduit 41 of the valve is in registry with conduit 17 from cylinder 32 and with conduit 18 leading from the valve to compartment 5. Plunger 31 is then pushed downward to force the oil from the cylinder through conduits 17, 41, and 18 into compartment 5. A further one quarter rotation counter-clockwise will block the cylinder from the compartments. Can 10 may then be shaken to thoroughly mix the oil with the gasoline in compartment 5. The size of cylinder 32 may be such that one cycle of oil withdrawal and injection may be sufficient or, in the alternative, several cycles may be employed.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. A portable measuring, metering, and mixing can comprising:

a first compartment provided with a filler spout and a pour spout;

a first compartment gauge for visually determining an amount of liquid within said compartment; and a second compartment provided with a filler spout;

a second compartment gauge for visually determining an amount of liquid within said second compartment; and metering means in fluid communication with said first and second compartments for withdrawing a selected amount of liquid from said second compartment as visually determined by said second compartment gauge, based upon an amount of liquid in said first compartment as visually determined by its gauge, and injecting said liquid into said first compartment for mixing in to a predetermined ratio based upon the volume of said first compartment and the ratio of liquids desired.

2. The can as described in claim 1 wherein said metering means comprises a cylinder, a plunger reciprocally movable within said cylinder for drawing liquid into and expelling liquid from said cylinder, and valve means for controlling liquid flow from said second compartment to said cylinder and from said cylinder to said first compartment.

3. The can as described in claim 2 wherein said valve means includes a manually rotatable valve.

4. The can as described in claim 2 wherein said valve means includes a first check valve between said second compartment and said cylinder and a second check valve between said cylinder and said first compartment.

5. A portable measuring, metering, and mixing can comprising:

a first compartment provided with a filler spout and a pour spout;

a first compartment gauge for visually determining an amount of liquid within said first compartment;

a second compartment provided with a filler spout;

a second compartment gauge for visually determining an amount of liquid within said second compartment;

metering means in fluid communication with said first and second compartments for withdrawing a selected amount of liquid from said second compartment as visually determined by said second compartment gauge, based upon an amount of liquid in said first compartment as visually determined by its gauge, and injecting said liquid into said first compartment for mixing in to a predetermined ratio based upon the volume of said first compartment and the ratio of liquids desired;

a protective lid covering said metering means; and a handle attached to said can for portability.

6. A portable measuring, metering, and mixing can comprising:

a first compartment provided with a filler spout and a pour spout;

a first compartment gauge for visually determining amount of liquid within said first compartment;

a second compartment provided with a filler spout;

a second compartment gauge for visually determining amount of liquid within said second compartment;

metering means in fluid communication with said first and second compartments for withdrawing a selected amount of liquid from said second compartment as visually determined by said second compartment gauge, based upon an amount of liquid in said first compartment as visually determined by its gauge, and injecting said liquid into said first compartment for mixing into a predetermined ratio-based upon the volume of said first compartment and the ratio of liquids desired; said metering means including a cylinder, a plunger reciprocally movable within said cylinder for drawing liquid into and expelling liquid from said cylinder and valve means for controlling liquid flow from said second compartment to said cylinder and from said cylinder to said first compartment.

7. The can as described in claim 6 wherein said valve means includes a manually rotatable valve.

8. The can as described in claim 6 wherein said valve means includes a first check valve between said second compartment and said cylinder and a second check valve between said cylinder and said first compartment.

9. The can as described in claim 6 further comprising:

a protective lid covering said metering means; and a handle attached to said can for portability.

* * * * *